US006062499A

United States Patent [19]

Nakamura et al.

[11] Patent Number: 6,062,499

[45] Date of Patent: May 16, 2000

[54] INJECTOR

[75] Inventors: Masahito Nakamura; Kiyoshi Kasahara, both of Wako, Japan

[73] Assignee: Honda Giken Kogyo Kabushiki Kaisha, Tokyo, Japan

[21] Appl. No.: 09/108,318

[22] Filed: Jul. 1, 1998

[30] Foreign Application Priority Data

Jul. 2, 1997 [JP] Japan ..... 9-191782

[51] Int. Cl.[7] ..... F02M 51/06

[52] U.S. Cl. ..... 239/585.1; 239/590.5; 239/585.4; 239/900

[58] Field of Search ..... 239/483, 533.12, 239/584, 590, 590.5, 585.1–585.5, 900

[56] References Cited

U.S. PATENT DOCUMENTS

| | | | |
|---|---|---|---|
| 4,060,199 | 11/1977 | Brune et al. | 239/585.5 X |
| 4,365,746 | 12/1982 | Tanasawa et al. | 239/585.5 X |
| 4,519,547 | 5/1985 | Kubach et al. | 239/533.12 X |
| 4,899,699 | 2/1990 | Huang et al. | 239/585.5 X |
| 4,909,439 | 3/1990 | Fu | 239/585.5 X |
| 5,570,843 | 11/1996 | Heyse et al. | 239/900 X |
| 5,613,640 | 3/1997 | Furuya et al. | 239/585.5 |
| 5,884,850 | 3/1999 | Norgauer | 239/585.5 |

FOREIGN PATENT DOCUMENTS

| | | | |
|---|---|---|---|
| 2-66380 | 3/1990 | Japan . | |
| 271562 | 5/1927 | United Kingdom | 239/533.12 |

*Primary Examiner*—Andres Kashnikow
*Assistant Examiner*—Steven J. Ganey
*Attorney, Agent, or Firm*—Arent Fox Kintner Plotkin & Kahn LLP

[57] ABSTRACT

An injector including an electrically operated valve connected to a pressurized liquid supply source, is provided in a fuel supply system of an internal combustion engine, to inject fuel from a fuel tank supplied under pressure by a fuel pump. The injector has a housing having a conduit to receive fuel and a movable core (member) disposed in the conduit. The movable core has a valve. When a solenoid is energized, the movable core moves against the flow of fuel to open the valve, while allowing fuel to flow between a conduit surface and the movable member to as far as the valve. Grooves are formed on at least one of the conduit surface and a surface of the movable core, preferably on the conduit surface, in a direction parallel to that in which the movable member moves. These grooves act as fluid passages, reducing the fluid resistance encountered by the movable core and enhancing the valve stroke response. Moreover, the conduit surface and the surface of the movable core in contact therewith are subject to high-hard coating treatment to improve durability.

14 Claims, 8 Drawing Sheets

INJECTOR

BACKGROUND OF THE INVENTION

1. Field of the Invention

This invention relates to an injector, such as that provided in the fuel supply system of an internal combustion engine to inject fuel supplied from a fuel tank under pressure.

2. Description of the Prior Art

In an injector comprising an electrically operated fuel valve such as that used in an internal combustion engine, a movable core (movable member) and a valve (needle valve) are generally connected together and accommodated in a fluid passage formed in a housing. Pressurized fuel from a fuel pump (via a delivery pipe) flows to a point near the valve, resides there so long as the valve is kept in the closed position by the force of a spring, and is injected or jetted from a nozzle at the tip of the injector when the valve is retracted by energization of a solenoid.

In this conventional injector only the valve located downstream (toward the tip side) is borne by the bearing surface of the fluid passage and the movable core located upstream does not contact the surface of the fluid passage. This portion is instead structured as a bearing (guide). This allows fuel to flow between the fluid passage surface and the movable core to as far as the valve. The response is therefore good since the fluid resistance encountered is low. However, the bearing structure between the valve and the bearing surface has to be machined to high precision. If it is not, the durability of the injector is degraded owing to valve tilting that occurs owing insufficient support of the load acting on the valve.

Japanese Laid-Open Patent Application No. Hei 2(1990)-66,380 (claiming the priority of German Patent Application No. P3825135.3 on Jul. 23, 1988) teaches an injector to be used for an internal combustion engine in which the movable core also has a bearing structure. Specifically, as shown in FIG. 4 of this publication, a guide flange 38 made of a non-magnetic substance is provided adjacent to a fixed core (sleeve) to serve as a bearing for the movable core.

FIG. 10 of this specification of the subject application illustrates this prior art structure. As shown, the movable core is retained with a slight gap of several $\mu$m to ten and several $\mu$m between its full peripheral surface and the guide flange 38.

The fuel (gasoline, methanol or the like) passing through the fluid passage is an incompressible fluid. Therefore, as shown in FIG. 10, operation of the valve produces a volume change throughout the fluid in the fluid passage corresponding to the valve movement (stroke).

The valve is pulled or lifted in the upstream direction against the fluid pressure. However, since only a slight clearance is present between the movable core and the guide flange 38 in this prior art fuel valve, a long time is needed for the volume change corresponding to the stroke to be completed. The response is therefore poor owing to this prolongation of the operation time. This makes it difficult to increase the amount of fuel injected per unit time. The severity of this problem increases with increasing fuel pressure.

On the other hand, in the first-described conventional injector arrangement in which the movable core does not have a bearing structure, the response is good but problems arise regarding machining precision and durability.

BRIEF SUMMARY OF THE INVENTION

An object of this invention is therefore to overcome the aforesaid drawbacks of the prior art by providing an injector offering high durability and excellent response.

Another object of the invention is to overcome the aforesaid drawbacks of the prior art by providing an injector that is superior in durability and response and also easy to manufacture.

Moreover, the magnetic materials that have generally been used for the housings etc. of injectors are low in hardness.

Another object of the invention is therefore to provide an injector wherein the hardness of the materials used is increased to improve durability despite use of a magnetic material.

To achieve the foregoing objects, a first aspect of the invention provides an injector made of an electrically operated valve connected to a pressurized liquid supply source to be supplied with liquid, comprising a housing having a conduit to receive the fluid from the pressurized liquid supply source, a movable member disposed in the conduit, the movable member being connected to the valve in such a manner that, when a solenoid is energized, the movable member moves against the liquid to open the valve, allowing the liquid to flow between a conduit surface and the movable member to be injected from the valve, and a groove formed on at least one of the conduit surface and a surface of the movable member in a direction parallel to that in which the movable member moves. Moreover, at least one of the movable member and the conduit surface are subject to high-hardness coating treatment.

In the first aspect of the invention, since at least one of the conduit surface and the movable member is formed with at least one groove parallel to the movement direction of the movable member, an injector of high durability and excellent response can be provided. Moreover, the degree of this effect grows more pronounced with increasing pressure of the injected fuel. In addition, the valve stroke time is shortened to enable reliable and precise control of flow rate over a wide range extending from low to high rates of flow.

In the second aspect of the invention, since the groove is formed to be semicircular in section, there can be provided an injector that, in addition to the foregoing merits, offers the further advantage of being easy to manufacture.

In the third aspect of the invention, since at least one of the conduit surface and the movable member is subjected to high-hardness coating treatment, there can be provided an injector that, in addition to the foregoing merits, is further improved in durability.

BRIEF EXPLANATION OF THE DRAWINGS

This and other objects and advantages of the invention will be more apparent from the following description and drawings, in which.

DETAILED DESCRIPTION OF THE PREFERRED EMBODIMENTS

Embodiments of the invention will now be explained with reference to the attached drawings.

Each embodiment takes an electrically operated fuel valve for injecting fuel (gasoline, methanol or the like) in an internal combustion engine as an example of the injector.

Figure 1:
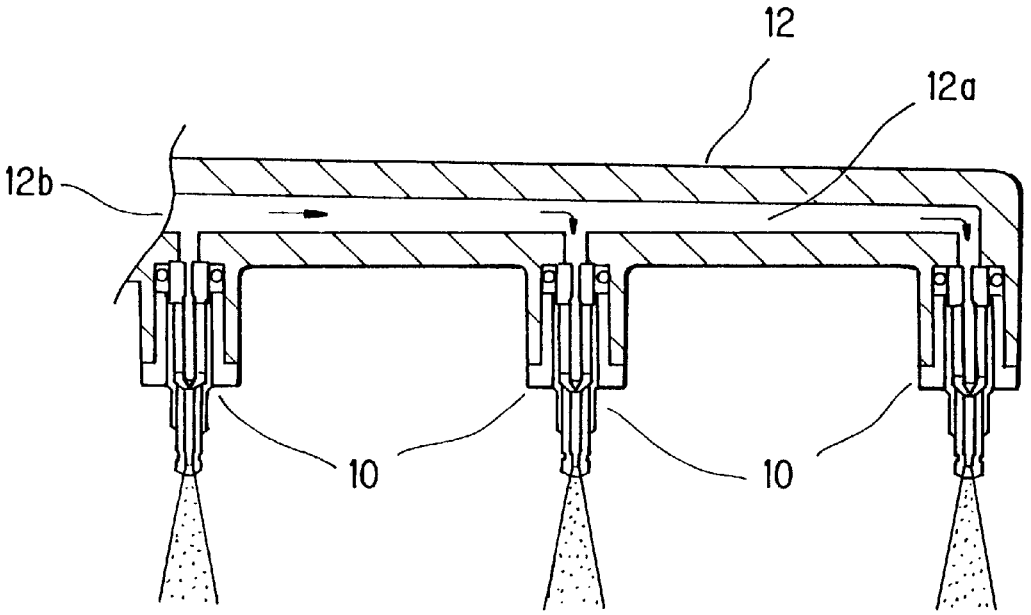
FIG. 1 is a schematic view showing injectors according to the invention taking as an example injectors connected to a fuel supply system of an internal combustion engine.

FIG. 1 is a schematic view showing part of the fuel supply system of an engine equipped with such injectors.

As shown in FIG. 1, a number of injectors 10 equal to the number of cylinders of the engine are connected to a delivery pipe 12. Fuel (fluid) contained in a fuel tank (not shown) is pumped through a fuel pipe (not shown) and supplied to the delivery pipe 12 by a fuel pump (not shown), whereafter it is injected or jetted into the cylinder combustion chambers (not shown) through the injectors 10.

As illustrated, the fuel line 12*a* of the delivery pipe 12 is tapered to decrease progressively in effective sectional area from the inlet side (left end in the drawing) toward the downstream side (right end).

More specifically, the effective sectional area of the fuel line 12*a* of the delivery pipe 12 is formed so as to make the fuel flow velocity uniform from the inlet 12*b* to the three injectors 10. By this the amount of fuel injected by the individual fuel injectors becomes uniform for a given valve open time.

Figure 2:
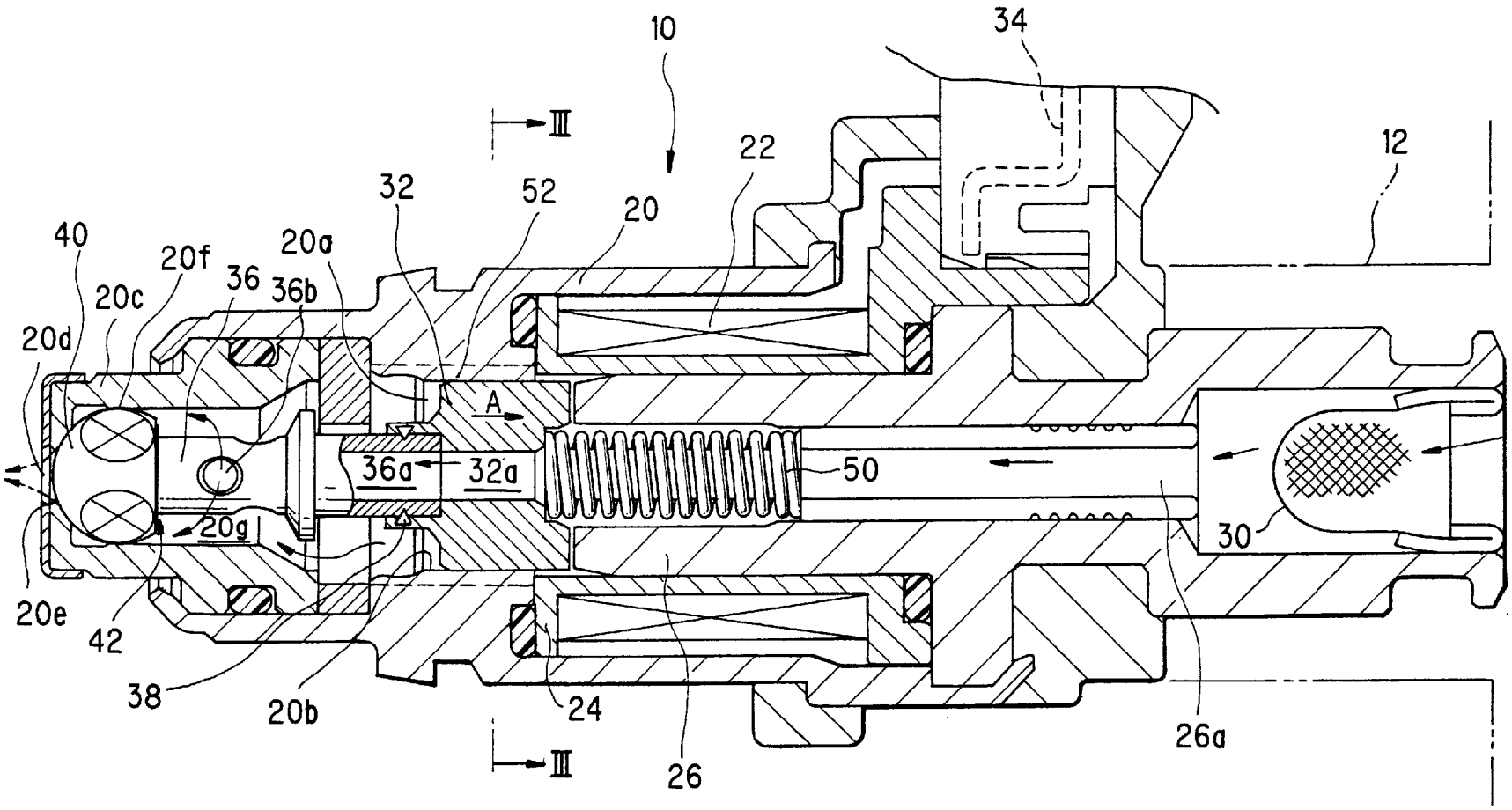
FIG. 2 is a sectional view of one of the injectors shown in FIG. 1.

The structure of one of the injectors 10 is shown in detail in the sectional view of FIG. 2.

As illustrated, the injector 10 has a housing 20. The housing 20 is made of a metallic magnetic material. A bobbin 24 wound with a coil 22 is accommodated in the housing 20 and a fixed core (sleeve) 26 is accommodated within the bobbin 24.

A portion of the fixed core 26 along its longitudinal axis is hollowed to form a conduit (fluid passage) 26*a* for passage of fuel. The fixed core 26 is connected to the delivery pipe 12 (see FIG. 1) at one end (right end in the drawing) and a screen filter 30 is disposed in the conduit 26*a* near the connection point for filtering the fuel to prevent invasion of debris.

The interior of the housing 20 is formed with a conduit (fluid passage) 20*a* of reduced diameter at a location adjacent to a movable core (member) 32. The movable core 32 is accommodated to be movable along the inner wall (bearing surface) 20*b* of the conduit 20*a* as separated therefrom by a gap of several $\mu$m to ten and several $\mu$m. The coil 22 and the fixed core 26 constitute a solenoid and the movable core 32 functions as a plunger. When electric power is supplied to the coil 22 through a terminal 34, the movable core 32 moves (executes a stroke) in the direction indicated by the arrow A in the drawing.

The movable core 32 is formed along its axis with a conduit (fluid passage) 32*a* that communicates with the fuel conduit 26*a* of the fixed core 26. The conduit 32*a* of the movable core 32 increases in diameter toward the downstream side, where it connects with an end portion of a hollow rod 36 through a weld or like means 38. The hollow interior of the hollow rod 36 constitutes a conduit (fluid passage) 36*a* which is of the same diameter as and communicates with the downstream end of the conduit 32*a* of the movable core 32. A downstream portion of the hollow rod 36 is formed with a hole 36*b* that communicates with the conduit 36*a*.

The hollow rod 36 has a ball valve 40 attached to its tip end through a weld means 42. In other words, the movable core 32 and the ball valve 40 are connected by the hollow rod 36 to constitute a needle valve.

The tip of the housing 20 is formed with an opening into which is fitted a member 20*c* of C-shaped section. The sectionally C-shaped member 20*c* is formed with an opening (nozzle) 20*d* that is formed thereabout with a valve seat 20*e*.

The ball valve 40 is configured so that its side surface contacts the inner wall surface of the member 20*c* at a location formed with a bearing surface 20*f* that bears the load acting on the ball valve 40.

The conduit 26*a* of the fixed core 26 and the conduit 32*a* of the movable core 32 are enlarged in diameter at their facing ends and a compression spring 50 is disposed at the large-diameter portion as compressed between the fixed core 26 and the movable core 32 with its one end seated on a shoulder portion formed in the conduit 26*a* of the fixed core and its other end seated on a shoulder portion formed in the conduit 32*a* of the movable core 32. The compression spring 50 thus urges the movable core 32 away from the fixed core 26 (leftward in the drawing). A hemispherical portion of the ball valve 40 is therefore pressed onto the valve seat 20*e* to close the opening 20*d*.

When the coil 22 is energized, a magnetic circuit is developed through the fixed core 26 and the housing 20, causing the movable core 32 to move in the direction of the arrow A under magnetic attraction by the fixed core 26. The hollow rod 36 and the ball valve 40 integrally connected to the movable core 32 therefore also move in the same direction.

Therefore, as indicated by arrows in FIG. 2, the pressurized fuel supplied from the delivery pipe 12 flows through the conduits 26*a*, 32*a* and 36*a* and the hole 36*b* of the hollow rod 36 into a chamber 20*g*. At this time, a part of the fuel flowing through the conduit 26*a* of the fixed core passes through the gap between the movable core 32 and the conduit surface 20*b* into the chamber 20*g*. The fuel then passes through the gap formed between the hemispherical portion of the ball valve 40 and the valve seat 20*e* to be discharged (injected) from the opening 20*d* to the exterior (into a cylinder combustion chamber).

As a first characterizing feature in this embodiment of the invention, the inner wall or surface 20*b* of the conduit 20*a* (bearing the movable core or member 32) is formed with grooves 52 running parallel to the movement direction of the movable core 32, i.e., in the axial direction of the movable core 32.

Figure 3:
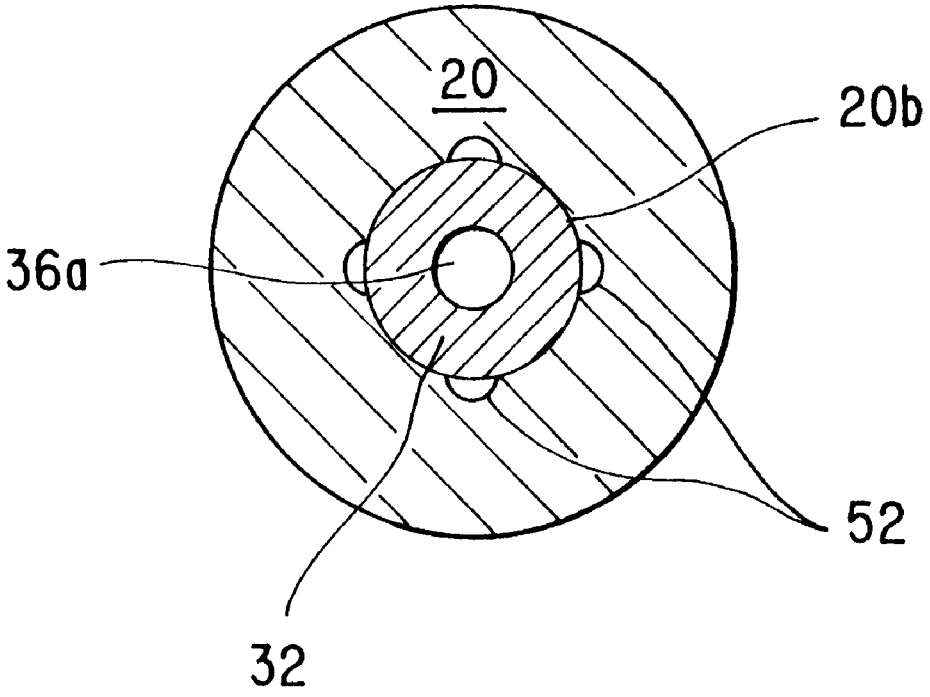
FIG. 3 is a sectional view taken along line III—III in FIG. 2.

FIG. 3 is a sectional view taken along line III—III in FIG. 2 showing the configuration of the grooves 52. Specifically, four grooves 52 angularly spaced by 90 degrees are formed on the surface 20*b* of the conduit 20*a* formed in the housing 20. The grooves 52 are semicircular in section. Their depth (radius) is, for example, 1.0 mm.

Figure 4:
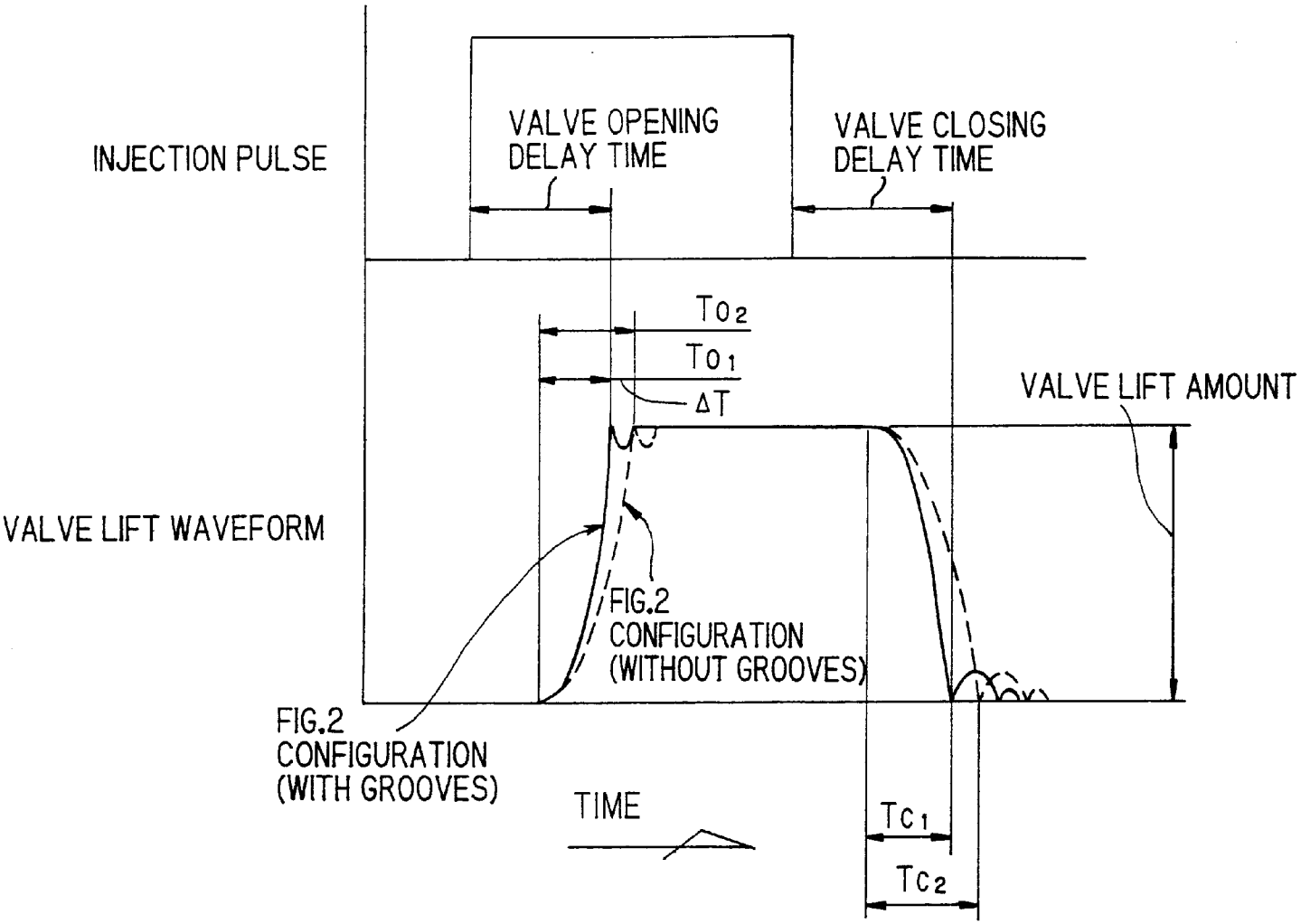
FIG. 4 is a graph based on test data indicating the response of the injector shown in FIG. 2.

Therefore, when the movable core 32 moves in the direction of the arrow A (executes a stroke) owing to energization of the solenoid, and the pressurized fuel located upstream of the movable core 32 is required to undergo a volume change corresponding to the stroke, a part of the fuel flows to the downstream side of the movable core 32 through the grooves 52. Accordingly, the fluid resistance encountered by the movable core 32 decreases and the response as a factor of injector performance rises in proportion. FIG. 4 is a graph (time chart) based on response data obtained when the injector 10 shown in FIG. 2 was tested with and without formation of the grooves 52. The tests were conducted at a fuel pressure of 15 kg/cm$^2$.

It can be seen from FIG. 4 that formation of the grooves 52 shortened the time needed for the movable core 32 to complete a stroke (lift) by $\Delta T$ ($=T_{02}-T_{01}$). The response as a factor of injector performance therefore improved in proportion and the ability to regulate flow rate reliably and precisely over a wide range extending from low to high rates of flow also improved in proportion. This effect is especially pronounced when fuel is supplied at high pressure.

In addition, the formation of the grooves 52 on the conduit bearing surface 20*b* proportionally reduced the inductance in the magnetic circuit compared with that in the case where no grooves were formed and, by this, further enhanced the response. Moreover, unlike in the first-described conventional arrangement in which the movable core does not have a bearing structure, the problem of durability degradation owing to valve tilting and the like does not arise because the bearing surface 20*b* is provided to support the load acting on the movable core 32.

Further, since the grooves 52 are formed to be semicircular in section, the outer diameter of the movable core 32 could be made larger than when compared in a case in which projections or the like were formed on the side of the movable core 32. In addition, provision of the grooves 52 on the side of the conduit 20*a* in the housing 20 makes them easier to form, while forming the grooves 52 to be sectionally semicircular increases their sectional area (flow passage area) and enhances their machinability.

Another characterizing feature of the injector 10 shown in FIG. 2 is that the bearing surface 20*b* of the conduit 20*a* formed in the housing 20 and the surface of the movable core 32 in contact therewith are subjected to high-hardness coating treatment.

Figure 5:
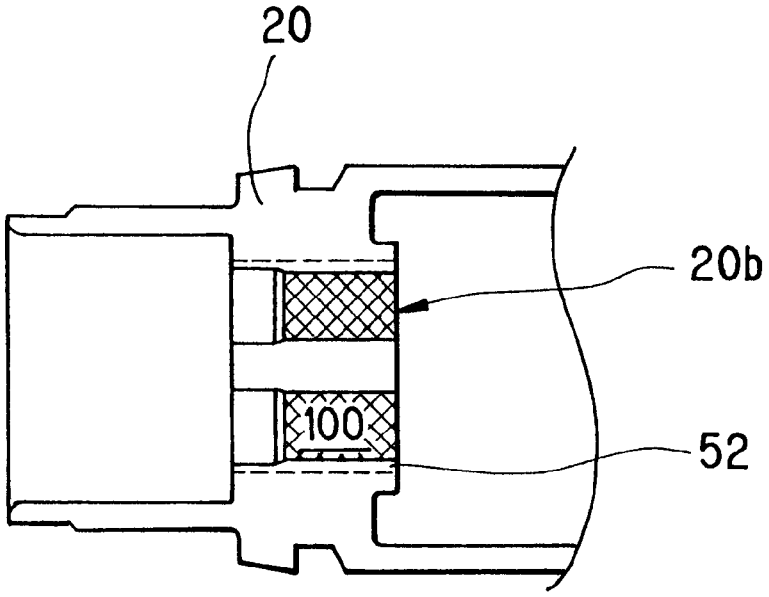
FIG. 5 is a partial sectional view for explaining a high-hardness coating treated state of the conduit formed in the housing of the injector shown in FIG. 2.

Specifically, as shown in FIG. 5, the bearing surface 20*b* of the conduit 20*a* is bake-coated with a fluororesin or other such antifriction material to form a high-hardness coating 100 (indicated by cross-hatching for convenience of illustration). Although the housing 20 (forming the conduit 20*a*) and the movable core 32 are made of a metallic magnetic material having lower hardness than a non-magnetic material, their hardnesses can be increased by this treatment. This makes it possible to employ a magnetic material of low original hardness and to obtain a further improvement in durability.

Figure 6:
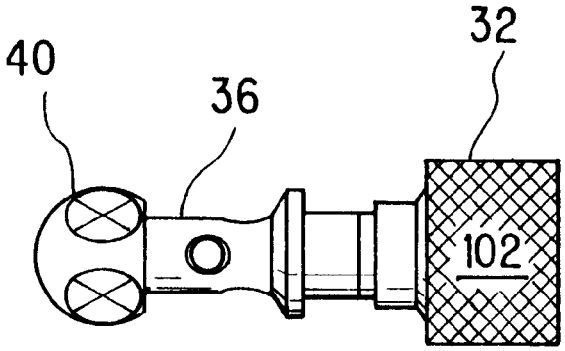
FIG. 6 is a side view for explaining a high-hardness coating treated state of the movable core (member) of the injector shown in FIG. 2.

The surface of the movable core 32 is also bake-coated with a fluororesin or other such antifriction material and is thereafter treated by hard-chrome plating or titanium coating, thereby forming a high-hardness coating 102 as shown in FIG. 6.

Although the bearing surface 20*b* and the surface of the movable core 32 are coated with the same type of fluororesin or other antifriction material, the antifriction material used to coat the bearing surface 20*b* is of higher hardness than that used to coat the surface of the movable core 32. This is because the operation of coating the movable core is relatively easy, so that substantially the same hardness can be obtained by further applying hard-chrome plating or the like on top of the coated surface in the foregoing manner.

Instead of subjecting both the bearing surface 20*b* and the surface of the movable core 32 to high-hardness coating treatment as described here, it is possible to subject only one of them, e.g., only the bearing surface 20*b*, to the treatment, although this results in some loss of durability. Thus, in this sense, one feature of the invention is that at least one of the movable member (core) and the conduit is subjected to high-hardness coating treatment.

Since the injector according to this embodiment is constituted in the foregoing manner, it achieves improved response as a factor of injector performance, and an increase in the amount of fuel injected per unit time. The durability is exceptionally high owing to the high-hardness coating treatment.

Figure 7:
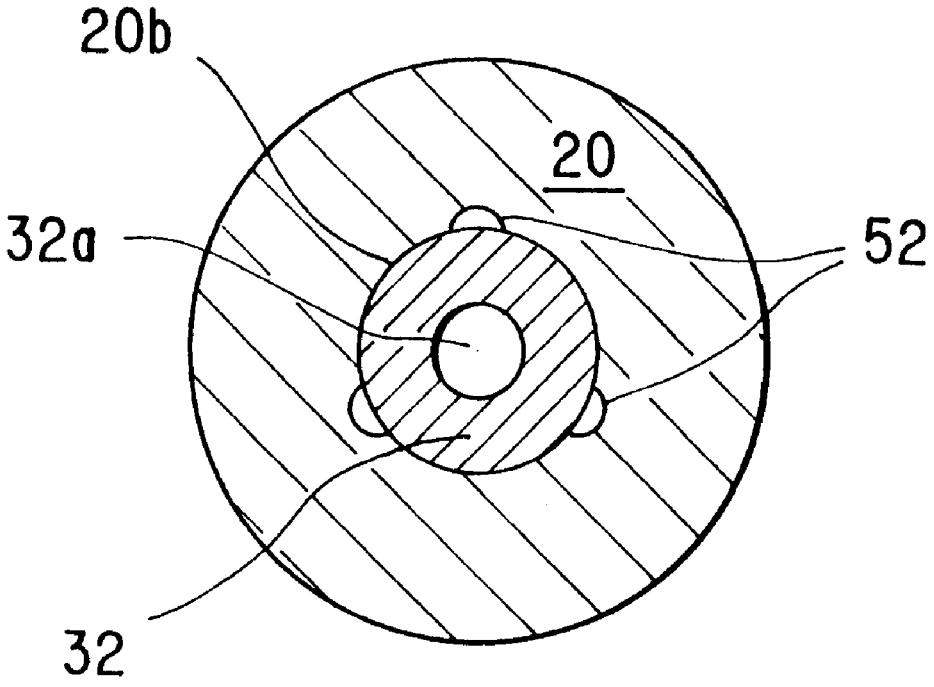
FIG. 7 is a sectional view similar to that of FIG. 3 showing the configuration of an injector according to a second embodiment of the invention.

FIG. 7 is a sectional view similar to that of FIG. 3 showing an injector according to a second embodiment of the invention.

In the second embodiment, three grooves 52 angularly spaced by 120 degrees are formed on the surface 20*b* of the conduit 20*a* formed in the housing 20. The second embodiment is the same as the first embodiment in its remaining structural features and provides the same effects.

Figure 8:
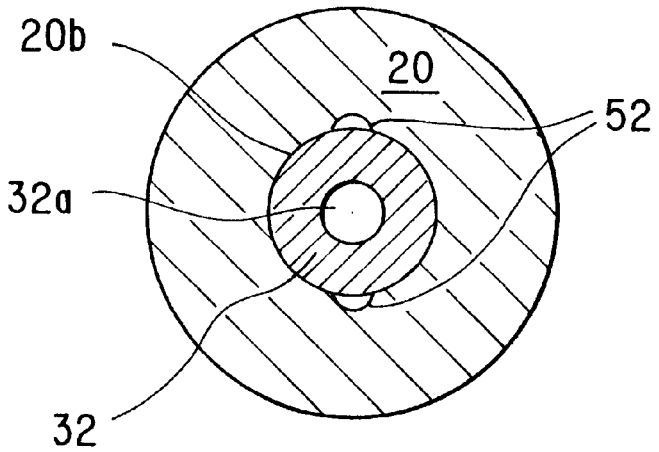
FIG. 8 is a sectional view similar to that of FIG. 3 showing the configuration of an injector according to a third embodiment of the invention.

FIG. 8 is a sectional view similar to that of FIG. 3 showing an injector according to a third embodiment of the invention.

In the third embodiment, two grooves 52 angularly spaced by 180 degrees are formed on the surface 20*b* of the conduit 20*a* formed in the housing 20. The third embodiment is the same as the first embodiment in its remaining structural features and provides the same effects.

Figure 9:
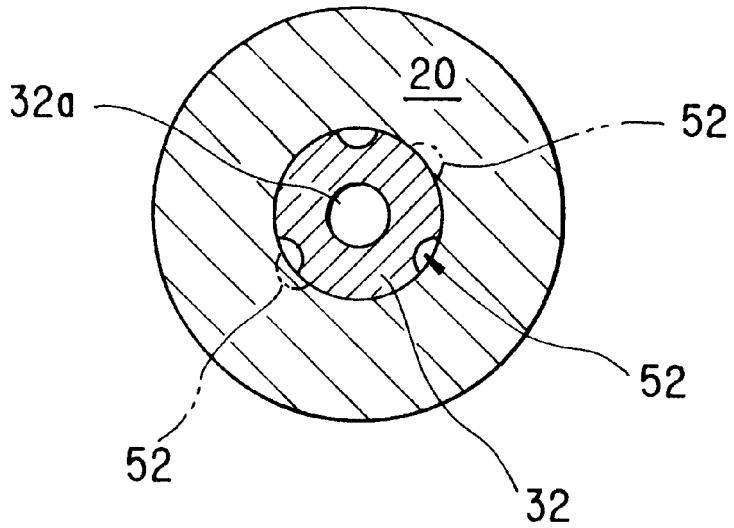
FIG. 9 is a sectional view similar to that of FIG. 3 showing the configuration of an injector according to a fourth embodiment of the invention.
Figure 10:
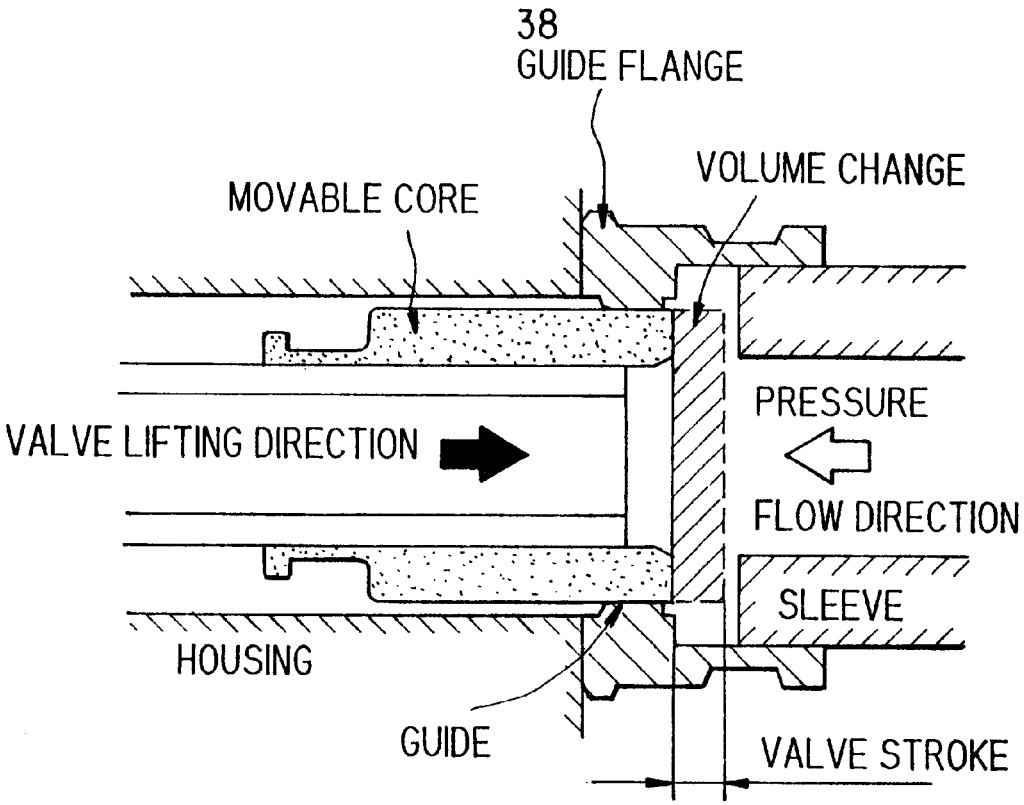
FIG. 10 is a diagram for explaining the structure of an injector in the prior art.

FIG. 9 is a sectional view similar to that of FIG. 3 showing an injector according to a fourth embodiment of the invention.

In the fourth embodiment, three grooves 52 angularly spaced by 120 degrees are formed on the surface of the movable core 32. The fourth embodiment differs from the first embodiment only in the point that the grooves 52 are provided on surface of the movable core. It is the same as the first embodiment in its remaining structural features and provides substantially the same effects.

In the fourth embodiment grooves 52 can be formed on the surface 20*b* of the conduit 20*a* formed in the housing 20 in addition to those formed in the movable core 32. This is indicated by broken lines in FIG. 9. Thus, in this sense, one feature of the invention is that at least one of the conduit surface and the movable member surface is formed with at least one groove parallel to the movement direction of the movable member. It is less preferable to form grooves 52 on the movable core 32 than to form grooves 52 on the surface 20*b* of the conduit 20*a* in the housing 20 because doing so reduces the sectional area of the movable core 32.

Although the number of grooves 52 in the first to fourth embodiments is between four and two, the invention is not limited to a number in this range and also encompasses the provision of only one or of five or more grooves. Specifically, an appropriate number of grooves for reducing the fluid resistance encountered can be selected within the range enabling support of the load on the movable core.

In addition, the sectional shape of the grooves is not limited to semicircular as described in the foregoing but can instead be rectangular or any of various other shapes.

Further, an alternate embodiment of the invention may omit grooves 52 on the surface 20*b* of the conduit 20*a* and/or on the surface of movable core 32 in favor of fluid passages which pass through the housing 20 and/or through the movable core 32 which allow the movement of fuel from the upstream end to the downstream end of movable core 32 during the movement of the movable core (execution of a stroke) in a like manner to the other possible embodiments and in a manner equivalent to the claimed invention.

Although the invention was described with respect to an injector used in an internal combustion engine, it can be applied not only to an injector for injecting engine fuel but also to an injector for injecting other liquids such as water or for jetting a gas such as compressed air.

Although the delivery pipe 12 in FIG. 1 is provided therein with a fuel line structured to vary in effective sectional area so as to make the fuel flow velocity uniform among the fuel injection valves, it is instead possible to make the length of the fuel line between the inlet of the delivery pipe 12 and the individual fuel injection valves uniform. The point is to make the amount of fuel injected per unit time uniform among the fuel injection valves. The delivery pipe 12 can be any structure capable of achieving this.

Although the invention has thus been shown and described with reference to specific embodiments, it should be noted that the invention is in no way limited to the details of the described arrangement, but changes and modifications may be made without departing from the scope of the invention, which is defined by the appended claims.

What is claimed is:

1. An injector made of an electrically operated valve connected to a pressurized liquid supply source to be supplied with liquid, comprising:

a housing having a conduit to receive the liquid from the pressurized liquid supply source;

a movable member disposed in the conduit, the movable member being connected to the valve in such a manner that, when a solenoid is energized, the movable member moves against the liquid to open the valve, allowing the liquid to flow between a conduit surface and the movable member to be injected from the valve; and a groove formed on the conduit surface in a direction parallel to that in which the movable member moves.

2. An injector according to claim 1, wherein the groove is semicircular in section.

3. An injector according to claim 1, wherein a plurality of grooves are formed on the conduit surface.

4. An injector according to claim 3, wherein the grooves are angularly spaced apart from each other by same degrees.

5. An injector according to claim 1, wherein the injector is connected to a fuel supply system of an internal combustion engine to inject fuel supplied from a fuel tank under pressure.

6. An injector according to claim 1, wherein the grooves are formed on the conduit surface and the surface of the movable member.

7. An injector according to claim 6, wherein a plurality of grooves are formed on each of the conduit surface and the surface of the movable member.

8. An injector according to claim 7, wherein the grooves are angularly spaced apart from each other by same degrees.

9. An injector according to claim 1, wherein at least one of the movable member and the conduit surface are subject to high-hardness coating treatment.

10. An injector according to claim 9, wherein at least one of the movable member and the conduit surface are bake-coated with antifriction material to form a high-hardness coating.

11. An injector according to claim 9, wherein both of the movable member and the conduit surface are bake-coated with antifriction material to form a high-hardness coating.

12. An injector according to claim 11, wherein the antifriction material to be used to coat the conduit surface is of higher hardness than that to be used to coat the movable member.

13. An injector according to claim 9, wherein a material forming the movable member and the conduit surface is a metallic magnetic material.

14. An injector according to claim 9, wherein the injector is connected to a fuel supply system of an internal combustion engine to inject fuel supplied from a fuel tank under pressure.

* * * * *